United States Patent [19]

Aihara et al.

[11] 4,240,827

[45] Dec. 23, 1980

[54] NONMAGNETIC ALLOY STEEL HAVING IMPROVED MACHINABILITY

[75] Inventors: Kenji Aihara; Masashi Takahashi, both of Amagasaki, Japan

[73] Assignee: Sumitomo Metal Industries Ltd., Osaka, Japan

[21] Appl. No.: 968,038

[22] Filed: Dec. 11, 1978

[30] Foreign Application Priority Data

Dec. 12, 1977 [JP] Japan ..... 52/149758

[51] Int. Cl.[3] ..... C22C 39/30

[52] U.S. Cl. ..... 75/123 AA; 75/123 B; 75/123 D; 75/123 F; 75/123 G; 75/123 H; 75/123 J; 75/123 M; 75/123 N; 75/124; 75/125; 75/126 B; 75/126 E; 75/126 F; 75/126 J; 75/126 K; 75/126 L; 75/126 M

[58] Field of Search ..... 75/123 B, 124, 126 B, 75/126 J, 126 L, 126 M, 126 R, 123 N, 123 A, 123 AA, 123 R, 123 D, 123 J, 123 H, 123 M, 126 K, 126 C, 126 D, 126 E, 126 F, 125, 123, 123 F, 123 G; 148/38

[56] References Cited

U.S. PATENT DOCUMENTS

| | | | |
|---|---|---|---|
| 3,010,823 | 11/1961 | Avery et al. | 75/123 A |
| 3,065,069 | 11/1962 | Monganello et al. | 75/126 B |
| 3,192,040 | 6/1965 | Goda, Jr. et al. | 75/123 AA |
| 3,846,186 | 11/1974 | Tipnis | 75/126 L |
| 4,009,025 | 2/1977 | Morelli | 75/123 B |
| 4,039,356 | 8/1977 | Schumacher | 75/125 |
| 4,121,953 | 10/1978 | Hull | 75/126 B |

FOREIGN PATENT DOCUMENTS

| | | | |
|---|---|---|---|
| 52-1507205 | 12/1977 | Japan . | |
| 52-1507215 | 12/1977 | Japan . | |
| 1106501 | 3/1968 | United Kingdom | 75/126 L |
| 399568 | 2/1974 | U.S.S.R. | 75/123 N |
| 523958 | 10/1976 | U.S.S.R. | 75/126 B |

OTHER PUBLICATIONS

Parasyuk et al., "Titanium Deoxidation and Modification of High-Manganese Steel," Metallurg, No. 7, pp. 17-19, 7/67.

*Primary Examiner*—M. J. Andrews

*Attorney, Agent, or Firm*—Watson, Cole, Grindle & Watson

[57] ABSTRACT

A nonmagnetic alloy steel containing by weight 5 to 30% Mn and 0.005 to 0.5% N (nitrogen), satisfying the condition that 100/9(C%+N%)+2(Mn%+Cu%) is more than 25% and containing at least one element to improve the machinability of the steel. Since the steel contains no Ni, the steel is inexpensive and can be used for bars for reinforcing concrete and bolts for civil engineering works and buildings.

4 Claims, No Drawings

NONMAGNETIC ALLOY STEEL HAVING IMPROVED MACHINABILITY

BACKGROUND OF THE INVENTION

1. Field of the Invention

The present invention relates to a high Mn content nonmagnetic alloy steel which is high in machinability.

2. Description of the Prior Art

Nonmagnetic alloy steels have been extensively used for component parts in electromagnetic apparatus. Typical of such nonmagnetic alloy steels is an austenite stainless steel. This steel usually contains more than 8% Ni by weight and is therefore relatively expensive and low in yield strength. As a consequence, an austenite stainless steel can be only used for component parts which do not require high mechanical strength and for small electromagnetic parts.

Nonmagnetic alloy steels have been recently used for such large scale constructions as magnetically levitated high speed ground transportation facilities (linear motor cars) and nuclear fusion reactor equipment. A very high magnetic field is associated with such equipment. When the structural steel and concrete reinforcing steel bars of such equipment are magnetized in this magnetic field, various undesirable effects will be produced. Furthermore, in terrestial magnetism observing facilities, fine magnetic changes must be precisely measured. The steel to be used for constructing such facilities is required to be high in strength and to have nonmagnetic properties. The nonmagnetic steel for such uses is utilized in comparatively large quanities and must therefore be inexpensive and yet should have the required mechanical strength.

In addition, nonmagnetic steel may have to be partly screw-threaded for use in pre-stressed concrete bars (PC-bars) or may have to be machined for use as component parts such as bolts and nuts. Therefore the steel must be high in machinability.

Examples of known nonmagnetic alloy steel having Mn as a main alloying element, being low in price and having high mechanical strength are disclosed in Japanese Laid-Open Pat. Nos. 150,721/52 and 150,720/52/1976 by one of the present inventors. However, in the disclosed steels, the difficulties in machinability of nonmagnetic alloy steel have not been solved.

On the other hand, a nonmagnetic alloy steel having improved machinability is known from U.S. Pat. No. 4,009,025. This steel has an Ni content of 3.5 to 5.5% by weight which is lower than the Ni content of the conventional austenite stainless steel and therefore the steel is comparatively inexpensive but is still relatively high in price because it contains significant amounts of Ni. Consequently, it is not economical to use this steel in large quantities for the above described applications.

SUMMARY OF THE INVENTION

A primary object of the present invention is to provide a nonmagnetic alloy steel low in cost, very low in magnetic permeability ($\mu \leqq 1.02$), particularly high in machinability and high in strength.

The compositions of the steel of the present invention are as follows:

A steel containing by weight not more than 1.5% C, 0.1 to 1.5% Si, 5 to 30% Mn, 0.005 to 0.5% N and at least one member selected from the group consisting of 0.05 to 1.0% S, 0.05 to 1.0% Pb, 0.05 to 1.0% Se, 0.01 to 0.5% Te and 0.001 to 0.05% Ca, the balance being Fe and incidental impurities, and wherein $100/9(C\ \% + N\ \%) + 2(Mn\ \%) \geqq 25\%$.

The reasons for limiting the elements of the composition of the above mentioned steel of the present invention are as follows:

C: This element is effective to stabilize the austenite structure and to make the steel nonmagnetic, and is also very effective in elevating the strength of the steel. As the C content increases, the strength rises, the austenite structure will be stabilized and, even if the steel is deformed severely, the steel will remain nonmagnetic. However, if the C content exceeds 1.5% by weight, the ingot will crack when heated or, in the cooling step after hot-rolling, a carbide will precipitate on the grain boundaries and the steel will become very brittle. On the other hand, the lower the C content, the higher the weldability and workability of the steel. Generally speaking, if the C content is extremely reduced, it will be difficult to obtain a stable austenite structure. However, in the steel of the present invention, other austenite stabilizing elements than C are contained to be more than of the specified amounts as mentioned above and therefore, even if the carbon content is as low as about 0.01%, a stabilized austenite structure will be obtained.

Thus, even with a low carbon content, if a composition with which a stabilized austenite phase is obtained is selected, and even if the solid-solute carbon content is decreased by decarburization or carbide precipitation at the time of welding, the nonmagnetism of the steel will not be lost.

Mn: This element is necessary to make the steel an austenite and maintain the nonmagnetic property of the steel. However, if the Mn content is less than 5%, an austenite stabilizing element such as Ni will have to be used in large amounts to maintain the nonmagnetic property. Therefore, the lower limit for the Mn content is 5%. If the Mn content exceeds 30%, the steel making furnace wall bricks in contact with the molten steel will be badly damaged and the steelmaking cost will rise considerably.

Si: More than 0.1% Si by weight must be contained as a deoxidizing agent for the steel. In addition, Si is effective to elevate the yield point of the steel. However, if the Si content exceeds 1.5% it will be difficult to maintain the nonmagnetic property of the steel. Therefore, the upper limit of the Si content is 1.5% by weight. N: N is very effective in stabilizing austenite. Structure of the steel. This effect is substantially the same as that of C.

N is very useful also as a steel strengthening element. Above 0.005% N by weight, an austenite stabilizing effect will appear. With the increase in the amount of N, the stability of austenite structure and strength of the steel will rise. However, when the amount of N exceeds 0.5% by weight, many holes will be produced in the steel and a sound ingot cannot be made. By the use of such amounts of N, the use of other austenite stabilizing elements can be decreased and a nonmagnetic alloy steel low in C content can be made as mentioned above. The N content can be obtained, for example, by adding Mn nitride or lime nitrogen into the molten steel.

Cu, Cr: More than 0.1% Cu and up to 9% Cr by weight serve to stabilize the austenite phase of the steel . Since Cu reduces the hot-workability of the steel, the steel must not contain more than 5% Cu by weight. The addition of more than 1.0% Cr by weight prevents the precipitation of carbide in the grain boundaries of the steel and is therefore effective to prevent the ingot from cracking during heating and to prevent the hot-rolled product from becoming brittle.

P, V, Nb, Ti, Zr, W, Al: These elements are added to elevate the yield strength of the nonmagnetic alloy steel of the present invention. As shown by the later described examples, even when these elements are not included, the steel of the present invention will have a yield strength such as more than about 40 kgf/mm$^2$ which is remarkably higher than that of the conventional austenite stainless steel (for example, AISI 304). However, when a higher yield strength steel such as for high tension steel bars, bolts and pins is required, with the addition of the above mentioned elements, the yield strength will be able to be elevated without adversely effecting the nonmagnetic property. P strengthens the matrix of the steel and elevates the yield strength with solid-solute strengthening. This effect of P is clear with the content of more than 0.05% by weight. However, if 0.5% P by weight is exceeded, the steel will become very brittle.

V, Nb, Ti, Zr, W and Al refine the crystal grains of the steel and contribute to elevate the yield strength. As for V, Nb, Ti, Zr and W, their carbides or nitrides precipitate during the aging treatment and show a remarkable strengthening effect. Such a strengthening effect becomes evident above 0.01% by weight for V and Nb and above 0.05% by weight for Ti, Zr and W. Generally, the higher the content of these elements, the higher the strengthening effect. However, if 4% by weight is exceeded for these elements, the austenite structure of the base will become unstable and the characteristics of the nonmagnetic steel will become difficult to be obtained. The grain refining effect of Al will become remarkable above 0.02%. However, since Al is also a ferrite stabilizing element, the addition of a large amount of Al will make the austenite phase unstable. Therefore, the Al content should be Correlations of C, N, Mn and Cu: As mentioned above, these elements all stabilize the austenite phase of the steel. However, their effects on the steel are different. In order to secure a stabilized austenite phase and to develop the feature of a nonmagnetic steel, the amounts of these elements to be used in the steel must be well controlled. By controlling $100/9(C\ \% + N\ \%) + 2(MN\ \% + Cu\ \%) \geqq 25\%$, even in as hot-rolled, or as variously worked after hot-rolling the steel will be insecured in austenite and an excellent nonmagnetic steel of a magnetic permeability $\mu$ of less than about 1.02 will be obtained. If the above mentioned condition is not met, the austenite structure will be varied by cold-working and therefore the magnetic permeability is likely to become elevated.

It is one of the most significant features of the steel of the present invention to improve its machinability by including at least one of the elements S, Pb, Se, Te and Ca in addition to the above mentioned elements. The reasons for limiting the contents of these elements are as follows:

S: If the S content is more than 0.05% by weight, the steel can be cut at a high speed in a lathe or milling machine. With the increase of the S content, the life of the cutting tool will be remarkably prolonged. When the S content exceeds 1%, the steel will become brittle, will become reduced in elongation and reduction of area and will become prone to cracking during hot-working.

Pb: If Pb is added, the workability will be greatly improved in turning, milling or drilling of the steel. The increase in the tool life in turning and milling of the steel is large. For example a conventional high Mn steel cannot be drilled even with a cemented carbide tool while a steel of this invention containing Pb can be drilled with such a tool. Unless more than 0.05% Pb is included, the workability remaines low. With an increase in the content of Pb, the workability will be improved. When the Pb content exceeds 1% by weight, the steel will be undesirably reduced in elongation and reduction of area.

Se: Se shows substantially the same effect as of S. With more than 0.05% Se, the effect will be recognized. From the viewpoint of the reduction of the ductility, a content of not more than 1.0% Se by weight is desirable.

Te: If not less than 0.01% Te by weight is included, the steel will be able to be drilled with a cemented carbide tool and the disposability of chips in turning will be improved. When the Te content exceeds 0.5% by weight, the ductility and strength will be reduced. Therefore, the upper limit is 0.5%.

Ca: If not less than 0.001% Ca by weight is included in the steel, the cutting resistance will be reduced and the life of the cutting tool will be prolonged. It has been thought that the addition of Ca will not contribute much to the improvement of the drill machinability of steel, but it has been found that in the high Mn steel of the present invention, Ca is effective to cause an improvement of the drill machinability with an increase in the Ca content, this beneficial effect will increase. However, when Ca exceeds 0.05%, the effect saturates.

Ca has also an action of sphering nonmetallic inclusions such as MnS in the steel. Therefore, when the anisotropy of the impact value of the steel containing S is undesirable, it will be beneficial to simultaneously add Ca.

Various steels according to the present invention are presented for the purpose of illustration in the following example. It should be understood that the example does not limit the invention as has heretofore been described.

EXAMPLE

Nineteen steels of the compositions as shown in Table 1 were melted in a high frequency induction furnace, were hot-rolled into steel bars of a diameter of 150 mm and were then air-cooled.

In Table 1, sample 1 represents an austenite stainless steel corresponding to AISI304, samples 2 to 5 represent steels for comparing purposes and samples 6 to 18 represent steels of the present invention. In making the steels of the present invention, N was added by supplying manganese nitride during melting.

TABLE 1

| | Compositions of Samples (in %) | | | | | | | | | | | | |
|---|---|---|---|---|---|---|---|---|---|---|---|---|---|
| Sample No. | C | Si | Mn | Ni | Cr | Cu | N | P | V, Nb Ti, W | Al | S | Pb, Se Te, Ca | $\frac{100}{9}$ (C + N) +2 (Mn + Cu) |
| 1 | 0.11 | 0.63 | 1.43 | 9.27 | 19.79 | 0.14 | 0.011 | 0.009 | — | 0.001 | 0.025 | — | 4.48 |
| 2 | 0.39 | 0.38 | 10.12 | — | 0.27 | 0.09 | 0.003 | 0.018 | — | 0.012 | 0.007 | — | 24.78 |

TABLE 1-continued

| Sample No. | C | Si | Mn | Ni | Cr | Cu | N | P | V, Nb Ti, W | Al | S | Pb, Se Te, Ca | $\frac{100}{9}(C+N)+2(Mn+Cu)$ |
|---|---|---|---|---|---|---|---|---|---|---|---|---|---|
| | Compositions of Samples (in %) | | | | | | | | | | | | |
| 3 | 0.89 | 0.32 | 13.88 | — | 0.11 | — | 0.0036 | 0.011 | — | 0.017 | 0.021 | — | 37.69 |
| 4 | 0.31 | 0.29 | 18.49 | — | 0.09 | — | 0.0035 | 0.009 | Nb 0.08 | 0.017 | 0.028 | — | 40.46 |
| 5 | 0.32 | 0.30 | 18.75 | — | 0.10 | — | 0.0046 | 0.121 | V 0.04, Nb 0.06 | 0.009 | 0.027 | — | 41.11 |
| 6 | 0.89 | 0.31 | 13.89 | — | 0.07 | — | 0.110 | 0.009 | — | 0.003 | 0.470 | — | 38.89 |
| 7 | 0.90 | 0.32 | 13.76 | — | 0.06 | — | 0.121 | 0.009 | — | 0.196 | 0.027 | Pb 0.52 | 38.86 |
| 8 | 0.90 | 0.82 | 13.76 | — | 0.06 | — | 0.120 | 0.011 | — | 0.198 | 0.027 | Se 0.43 | 38.85 |
| 9 | 0.89 | 0.31 | 13.89 | — | 0.07 | — | 0.100 | 0.010 | — | 0.189 | 0.020 | Te 0.19 | 38.78 |
| 10 | 0.96 | 0.48 | 14.21 | — | 0.09 | — | 0.005 | 0.008 | — | 0.102 | 0.39 | Pb 0.41 | 39.14 |
| 11 | 0.34 | 0.45 | 17.66 | — | 6.93 | — | 0.164 | 0.021 | — | 0.101 | 0.017 | Ca 0.011 | 40.92 |
| 12 | 0.32 | 0.27 | 18.46 | — | 0.08 | — | 0.118 | 0.110 | — | 0.162 | 0.45 | — | 41.79 |
| 13 | 0.30 | 0.29 | 18.48 | — | 0.06 | — | 0.119 | 0.009 | Nb 0.08 | 0.200 | 0.019 | Pb 0.53 | 41.62 |
| 14 | 0.23 | 0.52 | 18.56 | — | 8.04 | 0.27 | 0.153 | 0.012 | Nb 0.11 | 0.201 | 0.89 | Ca 0.006 | 41.92 |
| 15 | 0.31 | 0.30 | 18.53 | — | 0.05 | — | 0.187 | 0.018 | V 0.12, Nb 0.09 | 0.220 | 0.021 | Te 0.22 | 42.58 |
| 16 | 0.32 | 0.34 | 17.89 | — | 0.05 | — | 0.174 | 0.013 | V 0.14, Nb 0.11 | 0.199 | 0.021 | Pb 0.40 | 41.27 |
| 17 | 0.29 | 0.36 | 14.42 | — | 0.05 | 0.31 | 0.009 | 0.016 | Ti 0.32 | 0.105 | 0.026 | Se 0.39 | 32.78 |
| 18 | 0.29 | 0.35 | 18.50 | — | 0.05 | — | 0.126 | 0.019 | W 0.21 | 0.146 | 0.36 | | 41.62 |

The results of tensile tests, measurements of the magnetic permeability (by a magnetic balance) and machinability tests are shown in Table 2. (For the testing methods, refer to the notes in Table 2.)

TABLE 2

| | Mechanical Properties of Samples, Drilling Test Results and Turning Tool Life Test Results | | | | | |
|---|---|---|---|---|---|---|
| | Tensile strength (in kgf/mm$^2$) | Yield strength (in kgf/mm$^2$) | Elongation (in %) | Magnetic permeability (H = 2000 Oe) | Drill machinability (in numbers of holes) (See Note 1) | Turning tool life (in minutes (See Note 2) |
| 1 | 86.3 | 26.4 | 57.6 | 1.0018 | 7⅔ | 1.5 |
| 2 | 110.5 | 79.8 | 18.6 | 2.76 | 0 | 2.5 |
| 3 | 98.0 | 35.7 | 57.3 | 1.009 | 0 | 5.0 |
| 4 | 111.0 | 40.5 | 51.6 | 1.0022 | 0 | 1.5 |
| 5 | 128.7 | 64.3 | 52.3 | 1.0024 | 0 | 1.5 |
| 6 | 99.0 | 36.5 | 47.3 | 1.0023 | 8½ | 8.0 |
| 7 | 95.7 | 36.2 | 44.0 | 1.0027 | 17⅔ | 10.5 |
| 8 | 93.9 | 36.2 | 48.7 | 1.0025 | 9⅓ | 8.0 |
| 9 | 92.8 | 36.2 | 43.7 | 1.0026 | 15 | 10.0 |
| 10 | 90.3 | 36.7 | 42.3 | 1.0019 | 20½ | 12.5 |
| 11 | 110.6 | 38.6 | 52.7 | 1.0030 | 18⅔ | 17.0 |
| 12 | 100.3 | 45.7 | 44.0 | 1.0031 | 8⅔ | 8.0 |
| 13 | 108.2 | 44.5 | 44.7 | 1.0028 | 14½ | 10.0 |
| 14 | 109.4 | 39.0 | 38.7 | 1.0022 | 22½ | 19.0 |
| 15 | 111.0 | 60.6 | 46.0 | 1.0055 | 7⅔ | 8.0 |
| 16 | 120.5 | 62.8 | 40.0 | 1.0068 | 11 | 9.0 |
| 17 | 103.6 | 57.4 | 41.3 | 1.0056 | 9 | 7.0 |
| 18 | 93.0 | 49.8 | 40.0 | 1.0029 | 10½ | 9.0 |

Note 1:
Tool: Cemented carbide drill 10 mm in diameter (made of JIS K20)
Feed: 0.04 mm/rotation.
Rotating velocity: 500 rpm.
Hole depth: 20 mm
Note 2:
Tool: Cemented carbide cutter (made of JIS P20)
Cutting depth: 2.0 mm
Feed: 0.1 mm
Cutting velocity: 50 m/min.
Life judgment: Flank wear of 0.2 mm As evident from Table 2, the comparing steels cannot be drilled but the steels of the present invention show sufficient drill machinability. Furthermore, in turning, the increase in tool life is quite remarkable. The steels of the present invention are comparable to the comparing steels both in mechanical strength and magnetic permeability.

Thus, as set forth previously, the nonmagnetic alloy steels according to the present invention are good in machinability, very high in the yield strength and low in magnetic permeability and can be made at a low cost.

The nonmagnetic alloy steel of the present invention is best adapted for use in various structural members, concrete reinforcing steel bars, bolts and nuts but it is needless to say the steel can also be applied to other uses such as electric device parts which are to be nonmagnetic.

While the present invention has been described with reference to particular embodiments thereof, it will be understood that numerous modifications may be made by those skilled in the art without actually departing from the spirit and scope of the invention as defined in the appended claims.

We claim:

1. A non-nickel containing nonmagnetic alloy steel having improved machinability consisting essentially of by weight not more than 1.5% C, 0.1 to 1.5% Si, 5 to 30% Mn, 0.005 to 0.5% N and at least one member selected from the group consisting of 0.05 to 1.0% S, 0.05 to 1.0% Pb, 0.05 to 1.0% Se, 0.01 to 0.5% Te and 0.001 to 0.05% Ca, the balance being Fe and incidental impurities, and wherein 100/9(C %+N %)+2(Mn %)≧25%.

2. A nonmagnetic alloy steel having improved machinability according to claim 1 further containing at least one member selected from the group consisting of 0.1 to 5% Cu and 1 to 9% Cr, all % by weight, and wherein 100/9(C %+N %)'2(Mn %+Cu %)≧25%.

3. A nonmagnetic alloy steel having improved machinability according to claim 1 further containing at least one member selected from the group consisting of 0.05 to 0.5% P, 0.01 to 4% V, 0.01 to 4% Nb, 0.05 to 4% Ti, 0.05 to 4% Zr, 0.05 to 4% W and 0.02 to 1% Al, all % weight, and wherein 100/9(C %+Mn %)+2(Mn %)≧25%.

4. A nonmagnetic alloy steel having improved machinability according to claim 1 further containing at least one member selected from the group consisting of 0.1 to 5% Cu and 1 to 9% Cr and at least one member selected from the group consisting of 0.05 to 0.5% P, 0.01 to 4% V, 0.01 to 4% Nb, 0.05 to 4% Ti, 0.05 to 4% Zr, 0.05 to 4% W and 0.02 to 1% Al, all % by weight, and wherein 100/9(C %+Mn %)+2(Mn %+Cu %)≧25%.

* * * * *